United States Patent [19]

Anderson et al.

[11] Patent Number: 4,722,287

[45] Date of Patent: Feb. 2, 1988

[54] SORBENT INJECTION SYSTEM

[75] Inventors: David K. Anderson, E. Longmeadow, Mass.; Robert W. Koucky, W. Hartford, Conn.

[73] Assignee: Combustion Engineering, Inc., Windsor, Conn.

[21] Appl. No.: 77,471

[22] Filed: Jul. 24, 1987

Related U.S. Application Data

[63] Continuation of Ser. No. 882,321, Jul. 7, 1986, abandoned.

[51] Int. Cl.[4] ..... F23K 5/00

[52] U.S. Cl. ..... 110/263; 110/264; 110/265; 110/345; 110/347

[58] Field of Search ..... 110/260–265, 110/347, 203, 245, 345; 122/4 D

[56] References Cited

U.S. PATENT DOCUMENTS

| | | | |
|---|---|---|---|
| 4,147,116 | 4/1979 | Graybill | 110/263 |
| 4,303,023 | 12/1981 | Perkins | 122/4 D |
| 4,321,034 | 3/1982 | Taccone | 110/264 |
| 4,475,472 | 10/1984 | Adrian et al. | 122/4 D |
| 4,492,171 | 1/1985 | Brashears et al. | 110/265 |
| 4,519,995 | 5/1985 | Schrofelbaur et al. | 110/345 |
| 4,531,461 | 7/1985 | Sayler et al. | 110/264 |
| 4,547,351 | 10/1985 | Im et al. | 110/345 |
| 4,555,994 | 12/1985 | Voigt et al. | 110/264 |
| 4,555,996 | 12/1985 | Torbov et al. | 110/345 |
| 4,614,159 | 9/1986 | Suguira et al. | 110/265 |

*Primary Examiner*—Henry C. Yuen

*Attorney, Agent, or Firm*—Arthur E. Fournier, Jr.

[57] ABSTRACT

In a furnace (10) in which a sulfur-bearing fuel is burned, a sorbent material such as limestone is introduced into the upper portion of the furnace through a plurality of nozzle arrangements (40). Each nozzle arrangement comprises a pair of concentric pipes (42,44) with deflector means (46) located between the pipes and adjustable by means (54), so that the sorbent material introduced through the outer pipe is dispersed in an area near the furnace wall, while that introduced through the inner pipe is projected to the central portion of the furnace. There are sufficient nozzle arrangements, and they are so located, so as to cover substantially the entire cross-sectional area of the furnace with sorbent material.

1 Claim, 3 Drawing Figures

SORBENT INJECTION SYSTEM

This is a continuation of application Ser. No. 882,321, filed July 7, 1986, abandoned.

BACKGROUND OF THE INVENTION

In recent times, coal has become a viable fuel for generating steam. Some coals include a high percent of sulfur, which will be released to the atmosphere in the form of hydrogen sulfide or sulfur oxide unless steps are taken to prevent this release. One means of preventing this $SO_x$ release to the atmoshpere which is presently being used is to add a sorbent, such as limestone, to the furnace, so that the sulfur combines with the calcium and magnesium to form solid sulfates. There are problems associated with this solution. The limestone must be added at the proper location in the furnace so that the limestone is not deadburned. Also, the limestone must be dispersed throughout the combustion gases such that it will come into intimate contact with and react with most of the sulfur compounds, an stay in contact for an extensive period of time, at the proper temperature (1700°-2200° F.), so that much of the sulfur will combine with the calcium and magnesium to form sulfates. To compound the problem of good distribution of the sorbent throughout the gas flow, if the load on the steam generator changes, and the firing of the furnace is thus varied, the flow pattern of the combustion gases can change.

SUMMARY OF THE INVENTION

In accordance with the invention, sorbent, such as limestone, is introduced into the upper portion of the furnace through a plurality of concentric pipes. An adjustable member located in the annular space between the pipes permits the amount of, and flow characteristics of, the air-borne sorbent being introduced into the furnace. Thus, the concentric pipe arrangements can be adjusted to get the proper sorbent introduction to disperse it fairly evenly throughout the combustion gas flow. Other suitable gas, such as recycled flue gas, can be used instead of air to transport the sorbent.

DESCRIPTION OF THE PREFERRED EMBODIMENT

Figure 1:
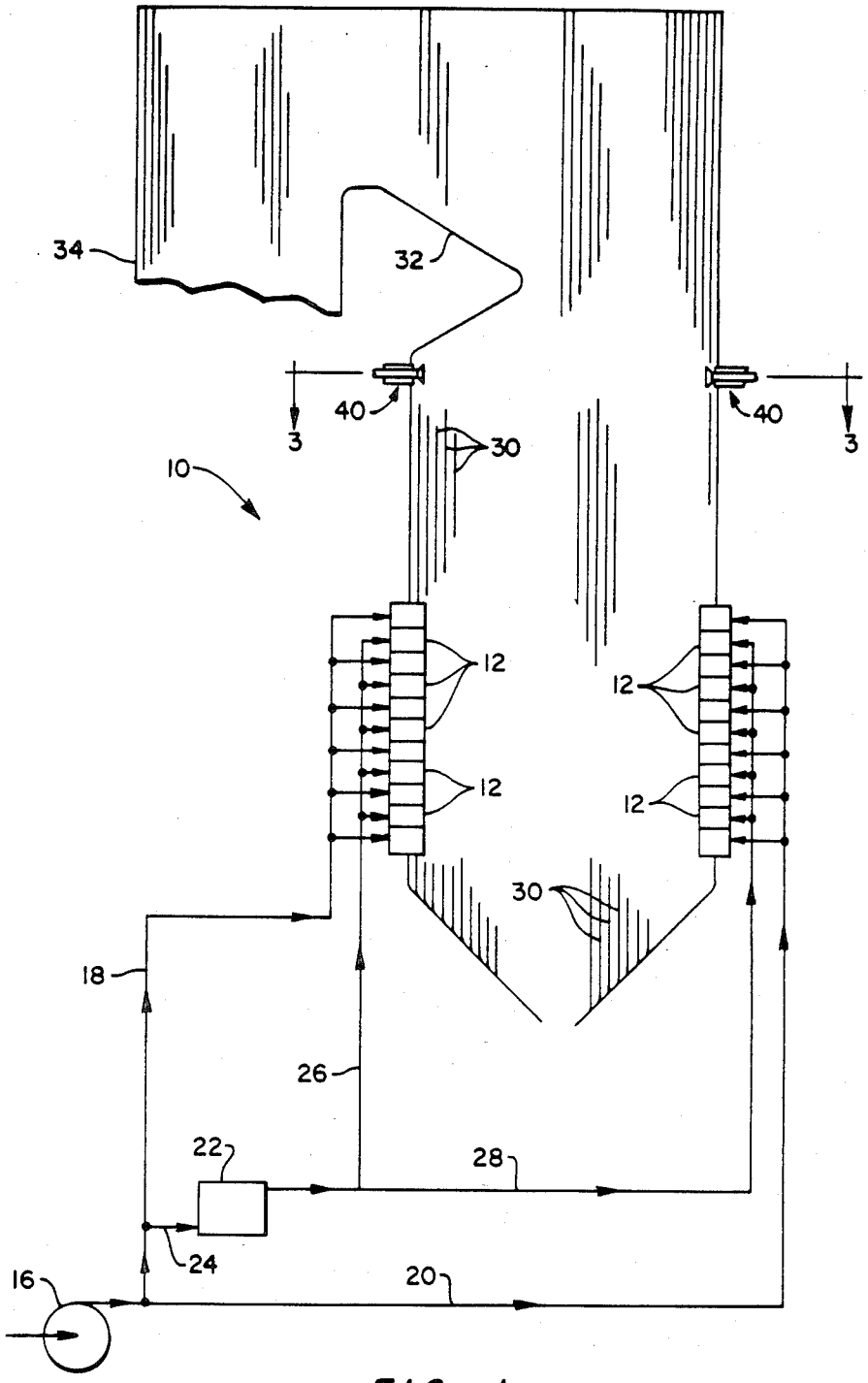
FIG. 1 is a sectional side view of a furnace incorporating the invention.

Looking now to FIG. 1, numeral 10 denotes a coal fired furnace, having a plurality of levels of burners 12 therein with each level having a burner mounted in each of the four corners thereof. Air is supplied to the burners from fan 16 through ducts 18 and 20. Air is also supplied to pulverizer 22 through duct 24. Pulverized coal having a sulfur content is transported to the burners in an air stream through ducts 26 and 28. There are separate air and fuel ducts leading to each individual burner, with separate valves and controls (not shown) also, so that each burner can be independently controlled. The combustion gases swirling upwardly into the furnace give up heat to the fluid passing through the tubes 30 lining all four of the furnace walls before exiting the furance through horizontal pass 32, leading to the rear pass 34. Both the furnace and the rear pass contain other heat exchange surface (not shown), for generating and superheating steam, as is well known in the art.

Located in the upper portion of the furnace are a plurality of nozzle arrangements 40, through which a sorbent material, such as limestone, can be introduced. The sorbent is conveyed in a stream of air or other gas, and introduced in such a manner that it intimately contacts as much of the combustion gases as possible, so that the magnesium and calcium can react with the sulfur in the gas to form sulfates. To accomplish this, it is desirable to introduce the sorbent in such a manner that it substantially covers the entire cross sectional area of the furnace.

Figure 2:
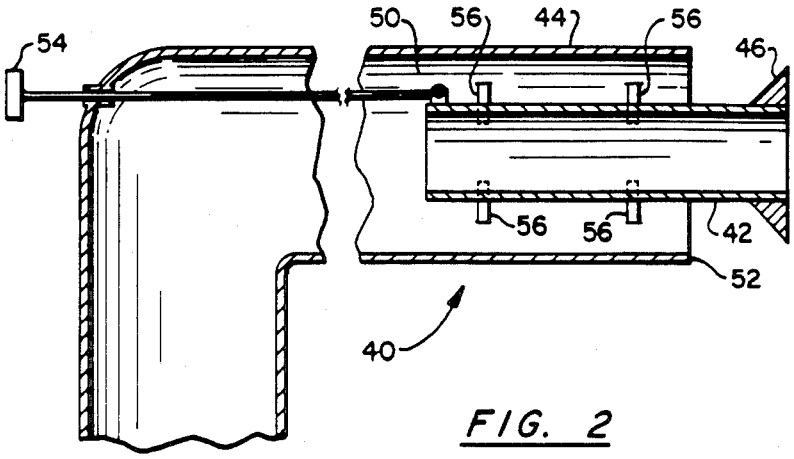
FIG. 2 is an enlarged view of one of the concentric sorbent injection nozzles.
Figure 3:
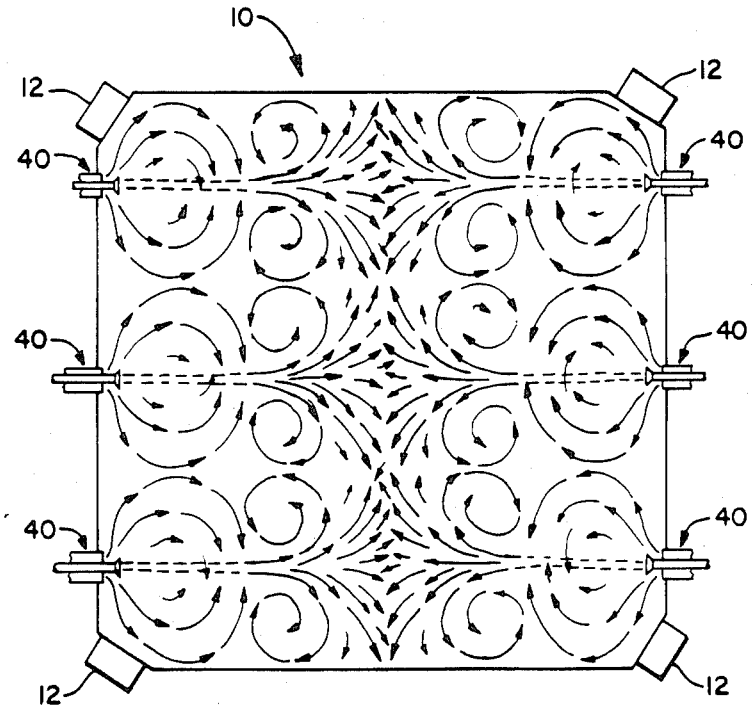
FIG. 3 is a view taken on line 3—3 of FIG. 1.

Looking now to FIGS. 2 and 3, the location of, and construction of, the nozzle arrangements 40 are shown in more detail as to how they accomplish the desired sorbent dispersion across the entire cross-section of the furnace 10. As can be seen in FIG. 2, each nozzle arrangement 40 consists of a pair of concentric pipes 42 and 44. Attached to and located near the outlet end of the inner pipe 42 is an annular frusto-conical deflector 46. This deflector causes the sorbent flowing in annular passage 50 to be discharged into the furnace in a dispersed manner close to the furnace wall. The high penetration flow through the inner pipe 42 is projected straight into the furnace, and will carry to the central portion thereof.

FIG. 3 illustrates how a number of the nozzle arrangements 40 positioned in the front and rear walls can be used to introduce sorbent in such a manner so as to completely cover the cross-sectional area of the furnace. The inner pipe 42 can be moved longitudinally, so that the deflector is positioned closer or further from the end 52 of the outer pipe 44, if desired, by manipulation of handle 54 (FIG. 2). Radial bars or rods 56 secured to the inner pipe 42 keep the pipes concentric during such movement. This adjustment permits more or less sorbent to be introduced close to the furnace wall, depending on the firing rate of the furnace. This adjustment also permits the initial introduction setting so as to assure complete coverage of the entire cross-sectional area of the furnace with sorbent. Each of the nozzle assemblies can be individually adjusted.

We claim:

1. A sorbent injection system for a sulfur-bearing fuel burning furnace having a plurality of sidewalls comprising: a plurality of nozzles mounted in a first portion of at least some of the sidewalls of the furnace operative for injecting sorbent material into the furnace, each of said plurality of nozzles including a first pipe having an inlet end and an outlet end, a second pipe having an inlet end and an outlet end, said second pipe being supported in concentric relation within said first pipe for movement relative thereto, said second pipe having a frusto-conical deflector supported at said outlet end thereof, radial members mounted on the exterior surface of said second pipe intermediate the inlet end and the outlet end thereof, said radial members being operative to cause said second pipe to maintain its concentricity relative to said first pipe as said second pipe is being moved relative to said first pipe, means connected both to said inlet end of said first pipe and to sail inlet end of said second pipe for supplying sorbent material for injection into the furnace to said first pipe and to said second pipe such that the sorbent material is made to flow through the interior of said first pipe and upon exiting in an unswirled state from said outlet end of said first pipe is deflected by said frusto-conical deflector thereby causing the sorbent material being injected into the furnace from said first pipe to embody a radial component and thus to be discharged into the furnace in a dispersed manner close to the sidewalls of the furnace and such that the sorbent material is made to flow through the interior of said second pipe and upon exiting in an unswirled state from said outlet end of said second pipe is injected into the center of the furnace along a path that forms an extension of the major axis of said second pipe, and adjustment means connected to said second pipe at said inlet end thereof and projecting outwardly of said first pipe so as to be accessible from the exterior of said first pipe operative for moving said second pipe relative to said first pipe, said adjustment means being operative to adjust the position of said frusto-conical deflector relative to said outlet end of said first pipe thereby enabling the flow pattern of the sorbent material injected into the furnace to be varied.

* * * * *